US006398085B2

(12) United States Patent
Foster

(10) Patent No.: US 6,398,085 B2
(45) Date of Patent: Jun. 4, 2002

(54) COVER SYSTEMS AND METHODS FOR ELONGATE MEMBERS

(76) Inventor: R. Coyne Foster, 2207 Evening Star La., Bellingham, WA (US) 98226

( * ) Notice: Subject to any disclaimer, the term of this patent is extended or adjusted under 35 U.S.C. 154(b) by 0 days.

(21) Appl. No.: 09/791,954

(22) Filed: Feb. 22, 2001

Related U.S. Application Data

(60) Provisional application No. 60/183,992, filed on Feb. 22, 2000.

(51) Int. Cl.[7] ..... B65D 47/00

(52) U.S. Cl. ..... 222/546; 222/562; 222/326; 220/796; 220/254

(58) Field of Search ..... 222/546, 545, 222/562, 326, 327; 220/254, 796; 215/17, 295; 128/844, 918

(56) References Cited

U.S. PATENT DOCUMENTS

| | | | | | |
|---|---|---|---|---|---|
| 1,760,841 | A | * | 5/1930 | Garhart | 222/562 |
| 1,909,209 | A | * | 5/1933 | Miller | 222/81 |
| 1,959,959 | A | * | 5/1934 | Kovacs | 215/58 |
| 2,761,598 | A | * | 9/1956 | Darlington, Jr. | 222/541 |
| 2,855,131 | A | * | 10/1958 | Gewecke et al. | 222/545 |
| 2,896,237 | A | * | 7/1959 | Owens et al. | 15/136 |
| 3,016,173 | A | * | 1/1962 | Stull | 222/541 |
| 3,361,304 | A | * | 1/1968 | Thompson | 222/189 |
| 3,378,168 | A | * | 4/1968 | Hildebrandt | 222/83 |
| 3,927,595 | A | * | 12/1975 | Ferguson | 84/322 |
| 4,213,546 | A | * | 7/1980 | Massey | 222/546 |
| 4,930,522 | A | * | 6/1990 | Busnel et al. | 128/844 |
| 4,972,849 | A | * | 11/1990 | Park et al. | 128/842 |
| 5,195,537 | A | * | 3/1993 | Tillotson | 128/844 |
| 5,284,159 | A | * | 2/1994 | Wilk | 128/844 |
| 5,325,871 | A | * | 7/1994 | Reddy | 128/830 |
| 5,327,911 | A | * | 7/1994 | Pien | 128/844 |
| 5,425,379 | A | * | 6/1995 | Broad, Jr. | 128/842 |
| 5,454,379 | A | * | 10/1995 | Shepherd | 128/842 |
| 5,992,415 | A | * | 11/1999 | Alla et al. | 128/830 |
| 6,116,468 | A | * | 9/2000 | Nilson | 222/108 |

* cited by examiner

*Primary Examiner*—Henry C. Yuen
*Assistant Examiner*—Frederick C Nicolas
(74) *Attorney, Agent, or Firm*—Michael R. Schacht; Schacht Law Office, Inc.

(57) ABSTRACT

A cover member for elongate members such as dispensing outlets for hardenable materials. The cover member defines an open end, a closed end, and an elongate wall extending between the open and closed ends. In one embodiment, a wall thickness of the cover member at the closed end is greater than a wall thickness of the cover member adjacent to the open end. In another embodiment, an inner projection is formed at the closed end. In yet another embodiment, an insert member is arranged in the closed end. In still another embodiment, the cover member comprises first and second wall layers defining the closed end and at least a portion of the elongate wall.

12 Claims, 3 Drawing Sheets

COVER SYSTEMS AND METHODS FOR ELONGATE MEMBERS

RELATED APPLICATIONS

The present application claims priority of U.S. Provisional Patent Application Serial No. 60/183,992, filed Feb. 22, 2000.

TECHNICAL FIELD

The present invention relates to cover systems and methods and, in particular, to cover systems and methods particularly suited for preserving hardenable materials that are dispensed from a container having a spout, nozzle, or other irregularly-shaped dispensing outlet which cannot easily be resealed.

BACKGROUND OF THE INVENTION

The present invention is of particular significance at covering an elongate member of unknown or variable size and shape, especially when the elongate member is of relatively small diameter. The present invention is of particular significance when used to cover an elongate dispensing member for contained materials, and that application will be described in detail below. The present invention may, however, have broader application as a cover for a gun barrel, toothbrush, marking pen, electrical switch, bolt threads, or the like.

The term "contained materials" as used herein refers to any material that remains in a flowable form when stored in a sealed container. For example, the contained material may be a lubricant such as grease contained in a grease gun. As briefly discussed above, the present invention is of particular significance when the contained material is a "hardenable material" that, when exposed to air, hardens or sets in a hardened form. Hardenable materials include adhesives, sealants, fillers, caulks, coatings, and the like.

Most hardenable materials are packaged, shipped, and displayed for sale in a sealed container to ensure that the material does not harden or set prior to initial use. The sealed containers in which many hardenable materials are sold may easily be resealed after the initial use to allow for further storage of any hardenable material not used during the initial use. For example, coatings such as paint are often packaged in cans having lids that may be removed and replaced to prevent contamination or hardening of the hardenable coating material.

However, many hardenable materials are sold in containers designed to facilitate application of the hardenable material but which make it difficult to reseal the container after the initial use. For example, hardenable materials such as adhesives, sealants, caulks, fillers, and some paint materials are often sold in tubes having a generally conical dispensing member that tapers down to a reduced diameter point. The dispensing member is cut, usually at an angle, to form an outlet opening, and the hardenable material is pushed or squeezed out of the tube through the dispensing member in a bead.

The thickness of the walls of the dispensing member is substantially constant; accordingly, by cutting the dispensing member along a desired cutting plane, the user may determine, within limits, the cross-sectional shape and area of the outlet opening. The ability of the user to select the desired cross-sectional shape and area of the outlet opening allows the user to control the size and shape of the bead in which the hardenable material is applied.

The use of a dispensing member as just described complicates the resealing of the container after the initial use. Because the dispensing member is intended to be cut at any one of a number of locations along its length, the exact geometry of the tip after the cut has been made is not known in advance. The fact that the dispensing member tapers to a reduced diameter point also complicates the mechanics of attaching the cover to the tip. In addition, the material from which such dispensing members are made is typically a low friction plastic, and the tip may also be contaminated by the hardenable material.

Accordingly, the consumer has been expected to devise or purchase a cover for the conical dispensing member through which hardenable materials are dispensed.

The Applicant is aware of a number of techniques and products that have been used in an attempt to seal the dispensing members of containers of hardenable material.

One such technique is simply to insert a nail or screw through the outlet opening into the dispensing member. The head of the nail or screw blocks the outlet opening and may, with certain hardenable materials, slow or prevent the hardening of the material remaining within the container. The nail or screw is removed to reopen the outlet opening to dispense hardenable material at a later time. This method does not form an adequate seal for many hardenable materials and thus allows the material to harden. In addition, the nail can rust and discolor the hardenable material within the container.

Another known method of resealing the dispensing member of a container of hardenable material is simply to cover the dispensing member with a metallic or plastic foil or the like. The foil is sometimes held in place using a rubber band. The foil does not form a reliable seal, and the foil tends to slip off of the tapered outer surface of the conical dispensing member, even with a rubber and or the like exerting pressure to hold the foil on the tip.

The Applicant and others have for several years sold an after-market product designed to engage a conical or tapered dispensing member in a manner that seals an outlet opening formed therein. This product is, in essence, a flexible cover member that is similar to a male condom. The flexible cover member defines an open end, a closed end, and an elongate wall portion generally in the shape of a tube extending between the open and closed ends. The cover member is manufactured and sold in a rolled configuration and then placed in an unrolled configuration when used to seal the dispensing member. When rolled, the inner wall of the closed end is exposed. The user brings this exposed inner wall into contact with the outlet opening and unrolls the cover member such that the elongate wall portion overlaps the outer surface of the dispensing member.

The cover material from which the cover member is formed is resilient and stretches somewhat as it is unrolled onto the dispensing member; this cover material also has a fairly high coefficient of friction. The resiliency and friction of the cover material in conjunction with the relatively large surface area over which the cover member engages the outer surface of the dispensing member function both to mechanically fix the cover member onto the dispensing member and to form a relatively airtight seal. The cover material may be any material that functions as described herein but is preferably latex or neoprene.

The flexible cover member as just-described has met with some market success but is subject to a number of problems that may have somewhat limited its acceptance in the market place.

Initially, to keep manufacturing costs down, the manufacturing processes and materials used to manufacture the flexible cover member are the desirably same as those used in the manufacture of male condoms. In particular, both products are manufactured by creating a mold having a plurality of mold projections that correspond to the inner dimensions of the product. The mold projections are dipped into liquid cover material and removed. The liquid cover material coats the mold projections and is allowed to harden. The product is then rolled off of the mold projection and packaged in the rolled form until use.

While this basic process works well for the relatively large diameter male condom, the relatively small diameter flexible cover member tends to unroll when removed from the mold projection. This tendency can be reduced somewhat by reducing the thickness of the walls of the cover member, and in particular the wall thickness at its closed end. However, when too thin, the latex becomes excessively permeable to air, which causes the hardenable material in the dispensing member to dry and harden.

The need thus exists for improved systems and methods for covering dispensing members for hardenable material having irregular or unknown geometries.

SUMMARY OF THE INVENTION

The present invention is a cover member for elongate members such as dispensing outlets for hardenable materials. The cover member defines an open end, a closed end, and an elongate wall extending between the open and closed ends. In one embodiment, a wall thickness of the cover member at the closed end is greater than a wall thickness of the cover member adjacent to the open end. In another embodiment, an inner projection is formed at the closed end. In yet another embodiment, an insert member is arranged in the closed end. In still another embodiment, the cover member comprises first and second wall layers defining the closed end and at least a portion of the elongate wall.

DETAILED DESCRIPTION OF THE INVENTION

Referring to FIGS. 1–6, depicted at 20 therein is a cover system constructed in accordance with, and embodying, the principles of the present invention. FIGS. 1–6 also depict the system 20 used in a method in accordance with the principles of the present invention.

Figure 1:
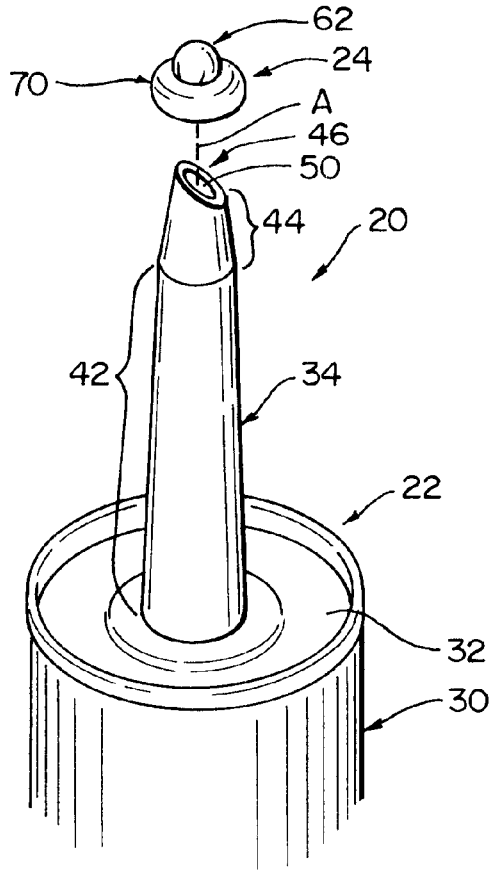
FIG. 1 is an isometric view of an exemplary caulking tube with a tapered or conical plastic dispensing member and an exemplary cover member of the present invention.
Figure 3:
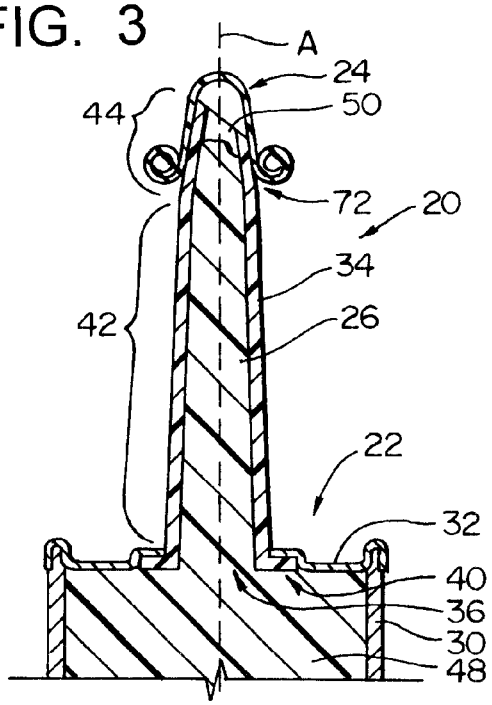
FIG. 3 is a cross sectional view of a caulking tube as depicted in FIG. 1 with the flexible cover partly extending over the caulking tube dispensing member.

Referring initially to FIG. 1, it can be seen that the exemplary cover system 20 comprises a dispensing system 22 and a cover member 24. As shown in FIG. 3, the dispensing system 22 is adapted to store and dispense a contained material 26.

The dispensing system 22 and contained material 26 are not per se part of the present invention and will thus be described only to the extent necessary for a complete understanding of the present invention.

The dispensing system 22 comprises a body 30, an end cap 32, and a dispensing member 34. During manufacture, the end cap 32 is attached to one end of the body 30 such that a substantially air-tight seal is formed between the cap 32 and body 30. A cap opening 36 is formed in the end cap 32.

The dispensing member 34 comprises a flange portion 40, first and second conical portions 42 and 44, and an end portion 46 and defines a dispensing axis A. In the exemplary dispensing member 34, the angle of the first conical portion 42 with respect to the dispensing axis A is slightly greater than the angle between the first conical portion 40 and the axis A. The exact geometry of the dispensing member 34 is not important to the present invention.

The conical portions 42 and 44 and end portion 46 of the dispensing member 34 extend through the cap opening 36 with the flange portion 40 against the end cap 32. A substantially air-tight seal is formed around the cap opening 36 between the flange portion 40 of the dispensing member 34 and the end cap 32. The container system 22 thus defines a material chamber 48 for containing the contained material 26.

The contained material 26 can be any liquid material that can be dispensed through the dispensing member 34 as will be described in detail below. The cover systems and methods of the present invention are of particular significance, however, when the contained material 26 is a hardenable material that changes to a set or dry state when it comes in contact with air. The exemplary hardenable material 26 is a caulk or other hardenable material such as an adhesive, a sealant, a filler, foam, coating, or the like.

Upon manufacture, the entire dispensing system 22 is sealed such that the material chamber 48 is substantially air-tight. In particular, the end portion 46 of the dispensing member 34 is closed and all other junctures are sealed.

Immediately prior to use, the user cuts the dispensing member 34 at or near the end portion 46 is to form an outlet opening 50 through which the hardenable material 26 may flow. The hardenable material 26 is forced out of the material chamber 48 through the outlet opening 50 by directly squeezing the body 30 or by use of a plunger device that acts on a piston within the material chamber 48.

The angle and location of the cut that forms the outlet opening determines the size and shape of the outlet opening 50. The size and shape of the outlet opening 50 in turn determine the characteristics of the bead of hardenable material 26 that is forced out of the material chamber 48.

The shape of the outlet opening 50 and the location of this opening 50 along the dispensing member 34 are thus determined by the user upon initial use and can vary from user to user.

Figure 5:
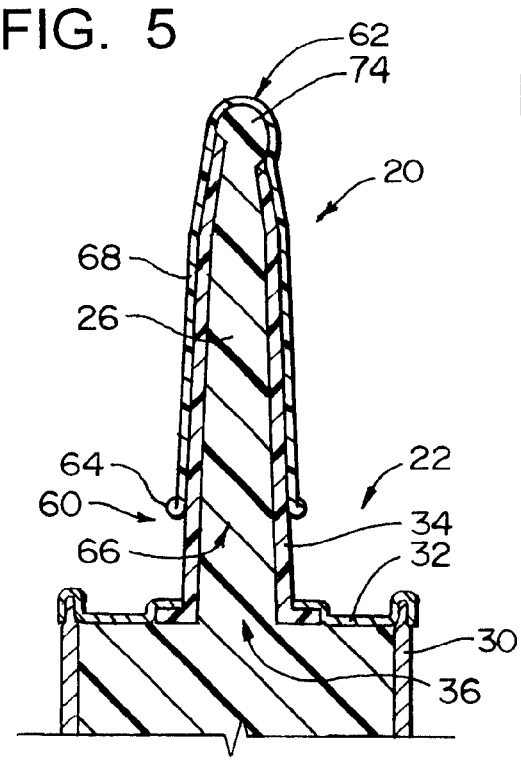
FIG. 5 is a cross sectional view similar to FIG. 4 depicting hardenable material within a tip chamber formed by the flexible cover member.

As shown in FIG. 5, the cover member 24 comprises an open end 60 and a closed end 62. The open end 60 is defined by a rolled edge 64 that further defines a cover opening 66. An elongate wall 68 open and closed ends 60 and 62.

The cover member 24 can be manufactured easily and inexpensively by dipping, injection molding, or any other suitable means that obtains the shape or shapes described herein. The exemplary cover member 24 is preferably formed by briefly dipping a mold projection into a liquid base material to coat the mold projection and then allowing the liquid material to harden in a shape that generally corresponds to the shape of the mold projection. Suitable base materials include latex and neoprene, but other materials with similar characteristics may be used.

Figure 2:
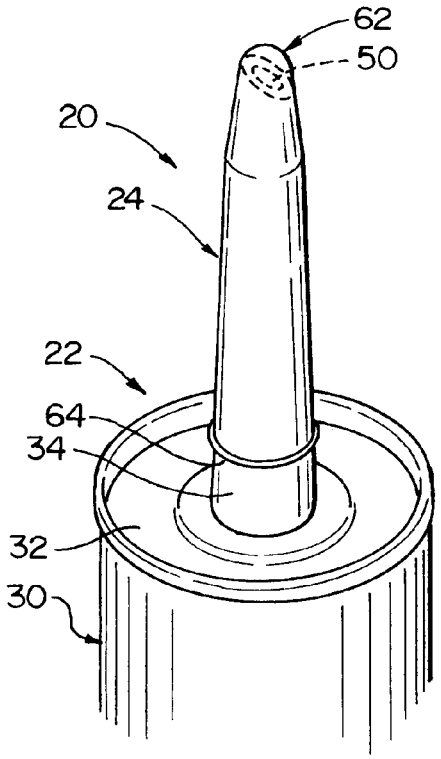
FIG. 2 is an isometric view of the caulking tube and cover member of FIG. 1 showing the cover member in place over the caulking tube dispensing member.

As shown by comparing FIGS. 1 and 2, the exemplary cover member 24 exists in rolled (FIG. 1) and unrolled (FIG. 2) configurations. In particular, the mold member 24 is peeled off of the mold projection and rolled back onto itself to form a rolled portion 70. The rolled portion 70 is formed by rolling the entire elongate wall 68 around the rolled edge 64; when fully rolled, the rolled portion 70 defines a roll opening 72 and the closed end 62 is adjacent to the center of the rolled portion 70.

The cover member 24 is preferably packaged for distribution, storage, and retail sale in its rolled configuration; the rolled configuration is compact and simplifies the process of placing the cover member onto the dispensing system 22.

In particular, as shown in FIG. 1, the rolled cover member 24 is arranged with the roll opening 72 facing the outlet opening 50. The rolled portion 70 is then brought into contact with the end portion 46 of the dispensing member 34. The user then manipulates the elongate wall 68 such that the rolled portion 70 unrolls along the second conical portion 44 as shown in FIG. 3 and then further along the first conical portion as shown in FIGS. 2 and 4.

Figure 4:
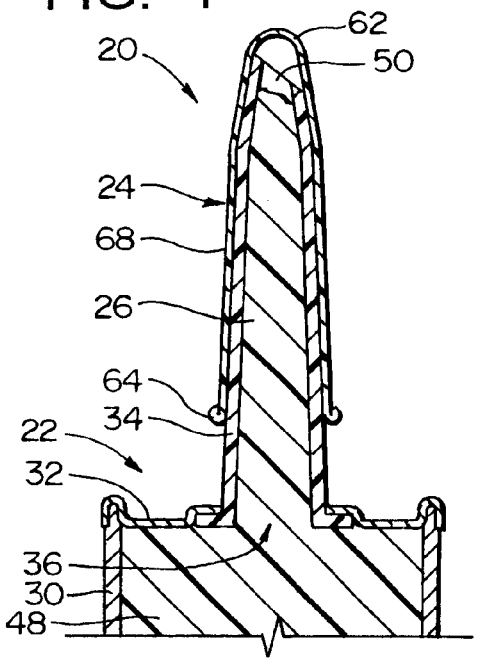
FIG. 4 is a cross sectional view similar to FIG. 3 depicting the flexible cover fully extending over the caulking tube dispensing member.

When fully unrolled as shown in FIGS. 2 and 4, the elongate wall 68 of the cover member 24 overlaps a substantial portion of the dispensing member 34 around and beyond the outlet opening 50. In addition, the material from which the cover member 24 is made is resilient. The cover member 24 is slightly undersized relative to the dispensing member 34; thus, as the cover member 24 unrolls, this material stretches slightly and creates a closure pressure over the entire surface area of the cover member 24 that is in contact with the dispensing member 34.

In addition, the material from which the cover member 24 is made is also preferably slightly tacky. The combination of the closure pressure as described above and tackiness of the material will, in most cases, create sufficient friction between the cover member 24 and the dispensing member 34 to secure the cover member 24 on the dispensing member 34 under normal conditions.

After the cover member 24 has been placed onto the dispensing member 34 as just described, a substantially air-tight seal is thus formed at the outlet opening 50 to re-seal the material chamber 48. This seal is enhanced by the substantial overlap between the cover member 24 and the dispensing member 34. Residual pressure within the material chamber 48 may cause a small amount of the hardenable material 26 to flow out of the outlet opening 50 into the closed end 62 of the cover member 24 as shown at 74 in FIG. 5. After a short time, however, the system 20 reaches an equilibrium state and will remain in this state indefinitely.

When the user wishes to use the dispensing system 22 to dispense additional hardenable material 26, the user simply removes the cover member 24 from the dispensing member 34. In particular, the user peels the rolled edge 64 away from the outer surface of the dispensing member 34 and back onto itself. Continued manipulation of the cover member 24 causes the elongate wall 68 to roll around the rolled edge 64 and reform the rolled portion 70. When the cover member 24 is again in its fully rolled configuration, the cover member 24 will detach from the dispensing member 34 as shown in FIG. 6.

Figure 6:
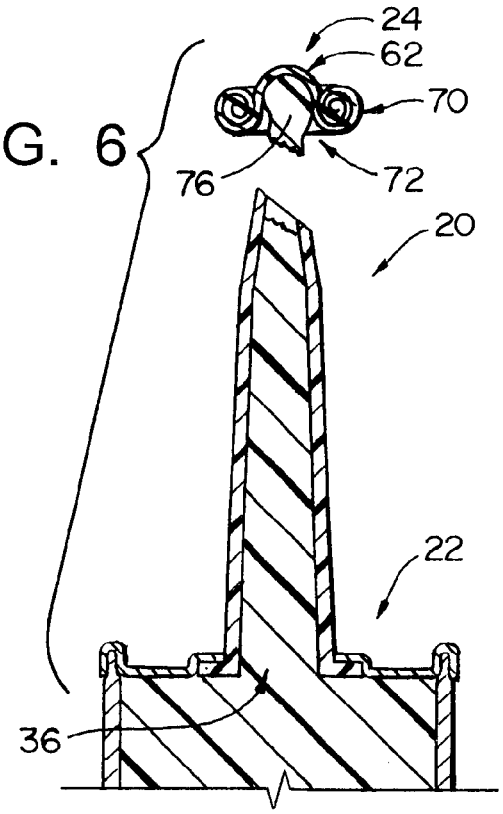
FIG. 6 is a cross sectional view similar to FIG. 5 depicting the removal of the flexible cover member.
Figure 7A:
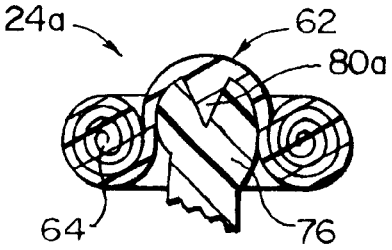
FIGS. 7A and 7B are cross sectional views of two exemplary cover projections sized and dimensioned to be received within an outlet opening defined by the dispensing member.
Figure 7B:
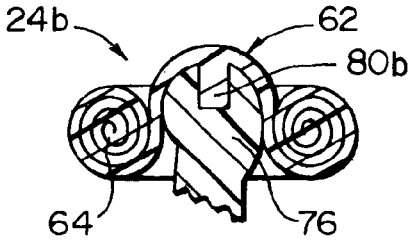

A small portion hardenable material 26 may remain in the closed end 62 as shown at 76 in FIG. 6 when the cover member 24 is removed from the dispensing member 34. Depending upon the length of time the system 20 has been in its equilibrium state, oxygen leaks around or permeability through the cover member 24 may have allowed the portion 76 of hardenable material 26 in the closed end 62 to harden. In most cases, this small hardened portion of hardenable material 26 is easily broken away to expose flowable hardenable material within the dispensing member 34.

The dispensing system 20 may then be used in a conventional manner. If not all of the hardenable material 26 is used during this second use, a cover member 24 may used to reseal the outlet opening 50 to preserve the remaining hardenable material 26 for later use. The cover members 24 are relatively inexpensive and may be considered disposable after a single use, but it is possible to re-use the cover members 24 in some conditions.

Referring now to FIGS. 7–10, the details of construction of several embodiments of the cover member 24 will now be described. Depicted at 24*a* and 24*b* in FIGS. 7A and 7B, respectively, are first and second embodiments of cover members that may be used as shown in FIGS. 1–6. The cover members 24*a* and 24*b* are shown in their rolled configurations and contain all of the elements of the cover member 24 described above, and these common elements will not be discussed in detail again below.

The cover members 24*a* and 24*b* have a substantially constant wall thickness from their rolled edge 64 to their closed end 62. Inner projections 80*a* and 80*b* are formed within the closed ends 62 of the cover members 24*a* and 24*b*. When the cover members 24*a* and 24*b* are mounted on a dispensing member 34, the projections 80*a* and 80*b* extend toward, and perhaps partly into, the outlet opening 50. Any hardenable material 26 that flows out of the outlet opening 50 into the closed end 62 will surround and come into contact with the projections 80*a* and 80*b*.

The projections 80*a* and 80*b* increase the surface area of the cover members 24*a* and 24*b* that comes into contact with the hardenable material 26 in the closed end 62. These projections further decrease the volume within the cover member 24 at its closed end.

As discussed above, a portion 76 of the hardenable material 26 in the closed end 62 may harden over time. The increased surface area created by the projections 80*a* and 80*b* increases the bond between the cover members 24*a* and 24*b* and the hardened portion 76 of the hardenable material 26 in the closed end 62. Additionally, the projections 80*a* and 80*b* occupy volume that would otherwise be occupied by the hardened portion 76 of the hardenable material 26. The projections 80*a* and 80*b* further effectively increase the wall thickness of the cover members 24*a* and 24*b* and thus decrease oxygen permeability through closed end 62 of the cover member 24.

Accordingly, the projections 80*a* and 80*b* may decrease drying of the portion 76 of material 26 within the closed end 62. And if this portion 76 does harden, the reduced volume of this portion 76 and increased bond between the portion 76 and the cover members 24*a* and 24*b* make it easier to remove the hardened portion 76 when removing the cover members 24*a* and 24*b*.

The exact shape of the projections 80*a* and 80*b* is not important to any given implementation of the present invention. The exemplary projection 80*a* is generally conical and triangular in cross-section, while the exemplary projection 80*b* has a generally rectangular in cross-section and could be a cylindrical or rectangular solid. These shapes are easily created by forming a corresponding depression in the tip of the mold projection used to form the cover members 24*a* and 24*b*. These and other shapes could incorporate ridges or sawtooth projections substantially transverse to the dispensing axis A to further enhance bonding between the hardened portion 76 and the cover member 24*a* and 24*b*.

Figure 8:
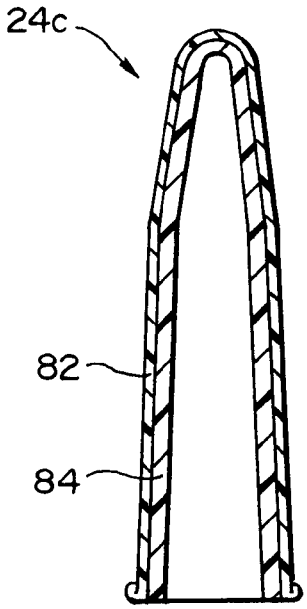
FIG. 8 is a cross sectional view of another exemplary cover member of the present invention.

Referring now to FIG. 8, depicted at 24*c* therein is yet another exemplary cover member constructed in accordance with the principles of the present invention. The cover member 24*c* is shown in its unrolled configuration; for clarity, the cover member 24*c* is not shown on a dispensing member, although the cover member 24*c* will normally be on a dispensing member when in its unrolled configuration.

The cover member 24*c* comprises first and second wall layers 82 and 84. The exemplary wall layers 82 and 84 are formed of different materials that serve separate purposes. In the exemplary cover member 24*c*, the first wall layer 82 forms the outer surface of the cover member 24*c* and is a material such as latex or neoprene that provides flexibility and structural strength to the cover member 24*c*. The exemplary second wall layer 84 is a metallic film or coating that would decrease oxygen permeability through the cover member 24*c* and increase resistance of the cover member 24*c* to ultra violet rays.

Other multi-layer arrangements are possible. For example, the two layers 82 and 84 described above may be reversed such that the first layer is the inner layer, to increase friction, and the second layer is the outer layer, to further increase resistance to ultra violet rays. A three-layer arrangement may comprise the first layer 82 being the inner layer, the second layer 84 being a middle layer, and a third outermost layer for abrasion resistance.

Figure 9:
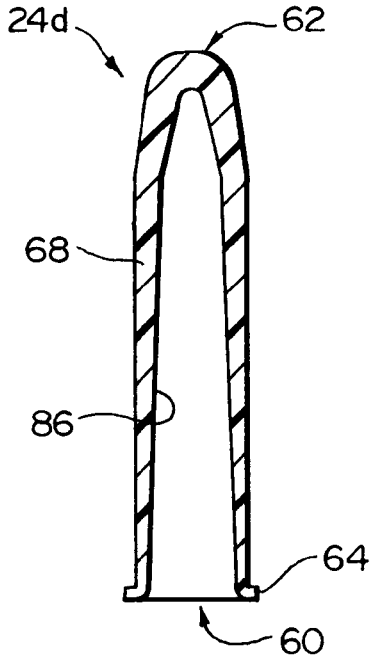
FIG. 9 is a cross sectional view of yet another exemplary cover member of the present invention.

Referring now to FIG. 9, depicted at 24*d* therein is yet another exemplary cover member constructed in accordance with the principles of the present invention. The cover member 24*d* is shown in its unrolled configuration for clarity.

The wall thickness of the cover member 24*d* is not uniform. To the contrary, the wall thickness of the cover member 24*d* increases from a minimum adjacent to the rolled edge 64 to a maximum adjacent to the closed end 62. The wall thickness is greatest at the closed end 62. The exemplary cover member 24*d* is designed specifically for use with tapered or conical dispensing members such as the dispensing member 34 described above. Accordingly, an inner surface 86 of the cover member 24 generally conforms to the shape of the dispensing member 34, although the inner surface 86 will be slightly undersized to ensure adequate closure pressure.

The reduced wall thickness of the elongate wall 68 makes it easier to place the cover member 24*d* in its rolled configuration, while the increased wall thickness at the closed end 62 substantially decreases oxygen permeability through the cover member 24*d*.

The exemplary cover member 24*d* employs a tapered wall thickness that gradually increases from the rolled edge 64 to the closed end 62. This shape can be obtained easily through injection molding; this shape can also be obtained by dipping. The speed at which the mold projection is removed after dipping may need to be reduced to create the increase in thickness adjacent to the closed end 62. In addition, the viscosity of the liquid in which the mold projection is dipped may need to be altered to allow surface tension to maintain the thickened walls during drying.

As an alternative, the wall thickness can be increased in a single step adjacent to the closed end 62. And instead of maintaining a generally cylindrical outer surface and tapering the inner surface as shown in FIG. 9, the inner surface can be kept substantially cylindrical and the outer surface tapered or stepped out adjacent to the closed end 62.

Figure 10:
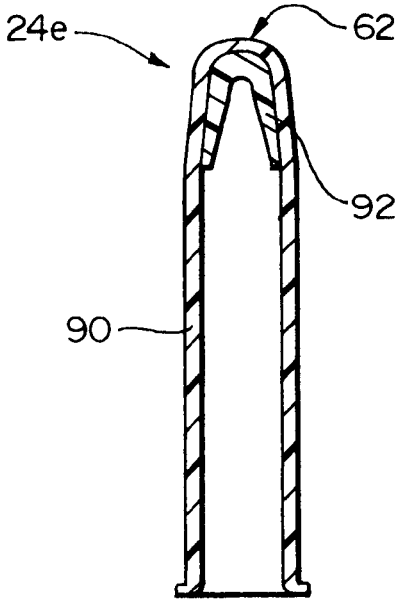
FIG. 10 is a cross sectional view of still another exemplary cover member of the present invention.

Referring now to FIG. 10, depicted at 24*e* therein is yet another exemplary cover member constructed in accordance with the principles of the present invention. The cover member 24*e* is shown in its unrolled configuration for clarity.

The cover member 24*e* comprises a wall layer 90 and an insert member 92. The wall layer 90 is or may be a conventional constant thickness latex or neoprene member, could be a multiple layer member as shown in FIG. 8, or could be a variable thickness member as described with reference to FIG. 9.

The insert member 92 is arranged within the closed end 62 of the wall layer 90. The insert member 92 can be similar to the second wall layer 84 and could be a metallic film or coating that would decrease oxygen permeability through the cover member 24*c* at the closed end 62. The insert member 92 could alternatively be a rigid structural member adapted to strengthen the cover member 24*e* at its closed end 62. The insert member 92 could further be a protective layer that would isolate and protect the wall layer 90 from the contained material 26. The insert member 92 could further be a material adapted to conform to or flow around or perhaps partly into the outlet opening 50 to enhance the seal at the opening 50.

From the foregoing, it should be clear that the present invention may be embodied in forms, combinations, and sub-combinations other than those specifically depicted and/or described above. For example, the projections 80 and 82 of the cover members 24*a* and 24*b* can be present invention should be determined by the claims appended hereto and not the foregoing detailed description.

I claim:

1. A cover member for a tubular dispensing member defining a dispensing outlet, the cover member comprising:

an open end;

a closed end;

an elongate wall extending between the open and closed ends; whereby a wall thickness of the elongate wall adjacent to the closed end is sufficient to create an oxygen barrier adjacent to the closed end;

a cross-sectional area of the cover member tapers from a maximum at a transition location along the elongate wall to a minimum at the closed end, where the transition location is spaced at least five percent of the distance along the elongate wall from the closed end to the open end;

the cover member exists in a rolled configuration and an unrolled configuration; and the cover member is placed onto the dispensing member with the cover member initially in the rolled configuration by placing the closed end against the dispensing outlet of the dispensing member and then unrolling the cover member along the dispensing member to form a substantially air tight seal cover the dispensing outlet.

2. A cover member as recited in claim 1, in which an inner projection is formed at the closed end.

3. A cover member as recited in claim 1, in which an insert member is arranged in the closed end.

4. A cover member as recited in claim 3, in which an insert member is a rigid member.

5. A cover member as recited in claim 3, in which an insert member is a seal member.

6. A cover member as recited in claim 3, in which an insert member is oxygen impermeable.

7. A method of covering a tubular dispensing member defining a dispensing outlet, the method comprising the steps of:

providing a cover member defining an open end, a closed end, and an elongate wall extending between the open and closed ends;

forming the elongate wall adjacent to the closed end with a wall thickness sufficient to create an oxygen barrier;

tapering a cross-sectional area of the cover member from a maximum at a transition location along the elongate wall to a minimum at the closed end, where the transition location is spaced at least five percent of the distance along the elongate wall from the closed end to the open end;

placing the cover member in a rolled configuration;

placing the closed end of the cover member in the rolled configuration against the dispensing outlet of the dispensing member; and unrolling the cover member along the dispensing member to form a substantially air tight seal over the dispensing outlet.

8. A method as recited in claim 7, further comprising the step of forming an inner projection at the closed end.

9. A method as recited in claim 7, further comprising the step of arranging an insert member in the closed end.

10. A method as recited in claim 9, in which the insert member is a rigid member.

11. A method as recited in claim 9, in which the insert member is a seal member.

12. A method as recited in claim 9, in which the insert member is oxygen impermeable.

* * * * *